United States Patent [19]

Haddon et al.

[11] 3,958,441

[45] May 25, 1976

[54] SKID RESISTANT SURFACE AND METHOD AND APPARATUS FOR FORMING THE SAME

[75] Inventors: Roger C. Haddon, Verona, Pa.; Jean-Pierre J. Habets, Broken Arrow, Okla.

[73] Assignee: Aluminum Company of America, Pittsburgh, Pa.

[22] Filed: Dec. 26, 1974

[21] Appl. No.: 536,630

[52] U.S. Cl. ..... 72/352; 52/177

[51] Int. Cl.[2] ..... B21K 23/00

[58] Field of Search ..... 29/155 R, 160, 163.5 R; 72/343, 352, 327, 253; 52/177; 119/28

[56] References Cited

UNITED STATES PATENTS

| | | | |
|---|---|---|---|
| 2,478,962 | 8/1949 | Ziehmer, Jr. | 72/327 |
| 3,098,292 | 7/1963 | Bunk | 72/352 |
| 3,172,343 | 3/1965 | Jacobs | 52/177 |

FOREIGN PATENTS OR APPLICATIONS

| | | | |
|---|---|---|---|
| 674,736 | 11/1963 | Canada | 72/352 |

*Primary Examiner*—Lowell A. Larson
*Attorney, Agent, or Firm*—David W. Brownlee; Andrew Alexander

[57] ABSTRACT

A skid resistant ribbed floor member has crack-free depressions formed in the ribs thereon using a punch and die in which the punch has a width greater than the transverse width of the rib and the die has an aperture generally less than the transverse width of the rib and less than the width of the punch.

10 Claims, 9 Drawing Figures

SKID RESISTANT SURFACE AND METHOD AND APPARATUS FOR FORMING THE SAME

BACKGROUND OF THE INVENTION

This invention relates to skid-resistant, ribbed floor members and method and apparatus for forming the same. The ribbed floor member is suitable for animal enclosures and the like. The method and apparatus form indentations in the wear surface of ribs of such floor members to provide added slip or skid resistance along the ribs. Ribbed floors are typically constructed from members assembled in a parallel spaced relation with the surfaces of the members having a plurality of ribs extending along their length to increase wear life and provide skid resistance transversely to the ribs. The ribs, however, provide less resistance to skid in the direction of the rib than they do transversely of the ribs. It has been observed that animals with relatively short legs, such as swine, for example, can walk or stand on such ribbed floors with relatively little skidding or sliding but animals with relatively long legs, such as cattle, for example, tend to slip or skid in the direction of the ribs. To eliminate such skidding in the direction of the rib, interruptions in the wear surface of the rib, such as, for example, depressions may be provided. Depressions may be formed by a conventional punch and die assembly where the punch has the same or smaller dimensions than the aperture in the die. When such a punch and die assembly is used to make depressions of effective depth in the ribs, severe cracking occurs along the base of the rib adjacent the depression. The cracks weaken the floor members and also provide recessed areas which are difficult to clean and, therefore, allow undesirable bacteria to collect. Conventional tools can make only relatively shallow depressions without cracking and are generally unsatisfactory because they do not provide adequate skid resistance. A floor member having crack-free skid resistance in all directions and a method and apparatus for forming the same are thus desirable.

OBJECTS

A purpose of this invention is to provide a ribbed floor surface with increased skid resistance in the direction of the ribs.

Another objective of the invention is to provide a method and apparatus for making indentations in the wear surface of a ribbed floor to increase its skid resistance.

A further objective of the invention is to increase the skid resistance of a ribbed member whose ribs serve as the wear surfaces in the floors of animal enclosures.

Yet another purpose of the invention is to provide ribbed members for floors for animal enclosures with improved skid resistance by providing crack-free indentations on the ribs.

These, as well as other objectives, will become apparent from a reading of the disclosure and claims and an inspection of the accompanying drawings appended hereto.

SUMMARY OF THE INVENTION

The present invention contemplates a novel process and apparatus for forming crack-free indentations in the wear surface of ribs on a floor member to enhance skid resistance of the floor in the direction of the ribs. The crack-free indentations are made in a floor member having at least one rib thereon using a die having an aperture therein with an effective extent less than the width of the base of the rib. The die supports the floor member with the die aperture opposite the rib, and a segment of the rib opposite the aperture in the die is pressed against the die by a punch to move material from the floor member into the aperture to form a depression in the rib without cracking the floor member. The end of the punch which presses a segment of the rib has a dimension along the rib generally greater than the extent of the aperture of the die in the same direction and a width which is at least as wide as the rib. Thus, a floor member is provided which has ribs on the surface thereof, providing skid-resistance in all directions.

DESCRIPTION OF PREFERRED EMBODIMENTS OF THE INVENTION

Figure 1:
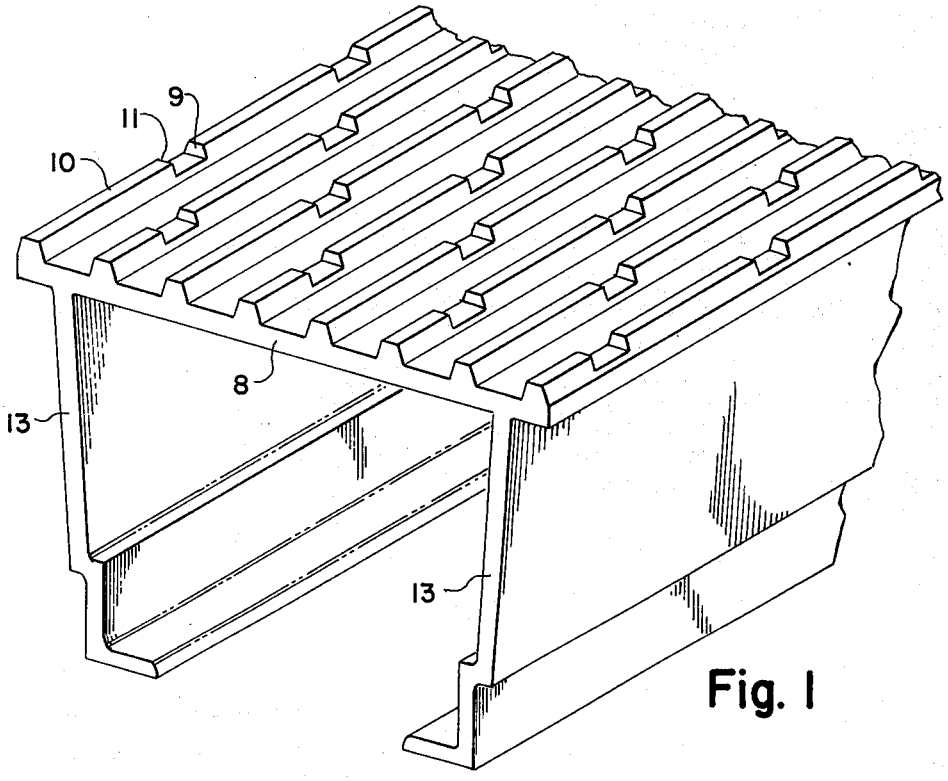
FIG. 1 is a perspective view of a typical ribbed floor member formed in accordance with the invention.

Referring now more specifically to FIG. 1, there is shown an extruded floor member which includes a web 8 with upwardly projecting longitudinally extending ribs 10 thereon and integral legs 13 on the member opposite the ribs. A staggered pattern of depressions has been formed in the ribs 10 in accordance with this invention. Preferably, the ribs 10 on the floor member are wider at their base than at the wear surface. The height of the ribs 10 is typically about 0.0625 inch on a web 8 of 0.0625 inch in thickness where the floor members are used in enclosures for swine. Where the floor members are used for cattle enclosures then a typical rib height may be 0.090 inch and the web thickness 0.080 inch. It will be appreciated that the larger the animal in the enclosure, the stronger the floor member required and consequently the higher the rib and the thicker the floor.

The following detailed description is directed to a method and apparatus for forming the depressions in the ribs in the floor member illustrated in FIG. 1 without cracking the floor member. While a single punch and die is herein illustrated and described, it is to be understood that a plurality of punches and dies may be provided to make a plurality of depressions in a ribbed floor member.

Figure 2:
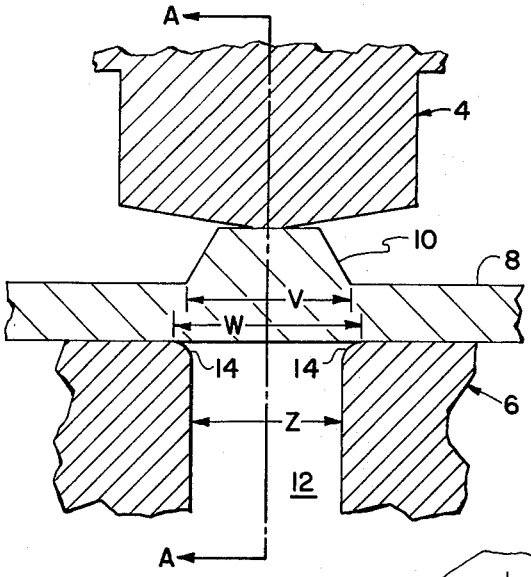
FIG. 2 is a fragmentary cross sectional view showing a punch and die with a portion of a floor member therebetween.

Referring to FIG. 2, the present invention includes a method of using a novel punch and die assembly generally referred to as 4 and 6, respectively. A web 8 with a rib 10 thereon is shown between the punch 4 and the die 6 prior to the punch being depressed to displace metal in a rib 10 on the web to form a depression in the rib. In a preferred embodiment of the invention, the punch 4 is rectangular in cross section and has a width crosswise of the rib at least equivalent to the width of the rib. However, as shown in FIG. 2, the punch 4 may have a width transverse of the rib 10 substantially greater than the width of a single rib. When the punch has a width transverse to the rib which is wider than the rib, the entire width of the rib is depressed by the punch and the depression which is formed has only end walls 9 and 11 (FIG. 1) and no walls on either side. Consequently, the depressions are, to a large extent, self-cleaning and, therefore, do not readily lose their resistance to skid as could happen if the depressions became filled with animal waste. A punch having a width substantially wider than the rib has another advantage in that variations in rib width, which is not uncommon in extruded floor members, can be tolerated while still maintaining the self-cleaning advantage. Furthermore, the same tools can be used for forming depressions in floor members having a variety of rib widths, for example, as when a stronger floor member is desired.

The die 6 has an aperture 12 therein aligned with punch 4 opposite the rib 10 on the floor member. The aperture 12 is preferably circular but may be square or rectangular in cross section. In order to produce a depressed segment in the rib without attendant cracking, the aperture 12 has an effective extent transversely of the rib less than the width of the rib. By effective extent it is meant that the aperture 12 on the die 6 should have a configuration such that upon displacing the punch lineally towards the die, the material in the floor member under lateral edges of the rib will be at least partially supported by the die around the die aperture so the metal will be squeezed or extruded laterally inwardly from between the punch and die into the die aperture, and will not be sheared by the punch and die so as to produce cracks in the floor member. A transition zone is provided on the die around the die aperture to facilitate lateral inward extrusion of metal from the floor member into the die aperture. The effective extent of the die aperture depends on a number of factors such as the height and width of the rib, the thickness of the floor member, the material of the floor member, the dimension and configuration of the punch, among others.

Aperture 12 preferably has a maximum extent represented by W at the mouth, the transition zone 14 and a minimum extent represented by Z. The transition zone 14 is preferably flared and, therefore, may have an increasing extent from the minimum to the maximum extent. When the transistion zone 14 is flared, the extent of the flare may be conveniently represented by the radius of an arc. The transition zone 14 may be frustoconical in which case the larger extent represents the mouth of the aperture.

As stated above, the aperture 12 in the die 6 is located opposite punch 4 and aligned under rib 10. More precisely, the aperture 12 and the rib 10 have a special relationship such that the minimum extent Z of the aperture crosswise of the rib is no greater than the width of the base of the rib represented by V. Preferably, the maximum extent W of the aperture should be equal to or slightly greater than the width V of the base of the rib. Maximum extent W may be smaller than the width V of the rib; but this may result in a greater force than, in certain instances, is economically desirable to displace the punch 4 lineally in the direction of the die 6.

Figure 3:
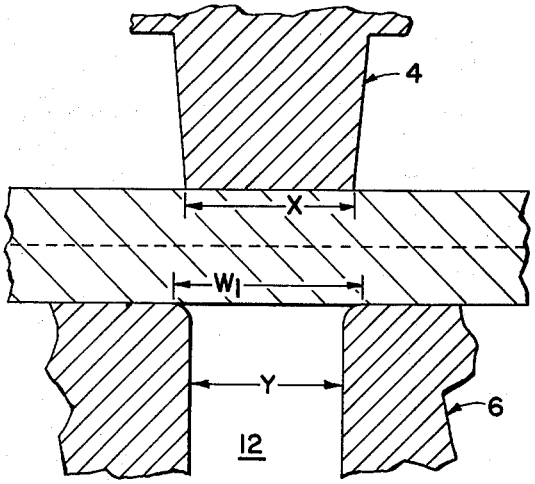
FIG. 3 is a cross sectional view taken along the line A—A of FIG. 2.

Referring to FIG. 3, it should be noted that the dimension of the punch 4 represented by X in the direction of the rib is dependent generally on the aperture 12 of die 6. That is, the dimension X of the punch should be equal to or greater than the minimum extent of the aperture along the rib represented by Y and equal to or less than the maximum extent represented by $W_1$ of the aperture 12.

To further illustrate the novel relationship which exists between the punch and die to produce depressions without the attendant cracking, it should be noted that if the punch is cylindrical and the die aperture circular and X and Y represent their respective diameters (FIG. 3) then the diameter X should be slightly larger than the diameter Y. So too, if the punch and die aperture are generally square or rectangular in cross section the dimension X of the punch along the rib should be slightly greater than the extent Y of the aperture in the same direction.

Figure 4:
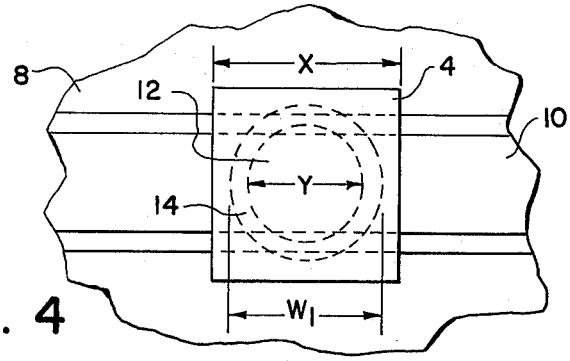
FIG. 4 is a plan view of a relationship of punch, rib and aperture.

Having thus described punch and die configurations which work satisfactorily, by referring to FIG. 4 it is to be observed that a preferred embodiment contemplates using a punch and die relationship wherein the punch 4 has a generally rectangular cross section and the cooperating die has an aperture 12 of a generally circular cross section. Preferably, in this embodiment the dimension X of the punch 4 along the rib 10 is substantially equal to the maximum extent $W_1$ of the aperture 12 along the rib 10. To more fully illustrate the preferred embodiments of the rectangular shaped punch and circular aperture by example, if the dimension X of the punch is 0.250 inch and the minimum diameter of the aperture Y is 0.188 inch the arc forming the transition zone 14 may have a radius of 0.031 inch to form a maximum aperture diameter $W_1$ of 0.250 inch. Thus, having stated the preferred relationship of punch to die aperture, it is to be observed that the dimension X of the punch along the rib may be slightly smaller than the diameter Y of the aperture or in certain instances the dimension X of the punch along the rib may be larger than the maximum diameter of the die aperture $W_1$. However, in the latter instance, it will be appreciated by those skilled in the art that a punch having a dimension X which is a great deal larger than the maximum diameter of the die aperture $W_1$ can result in requiring press loads that may be economically undersirable to form depressions.

Figure 5:
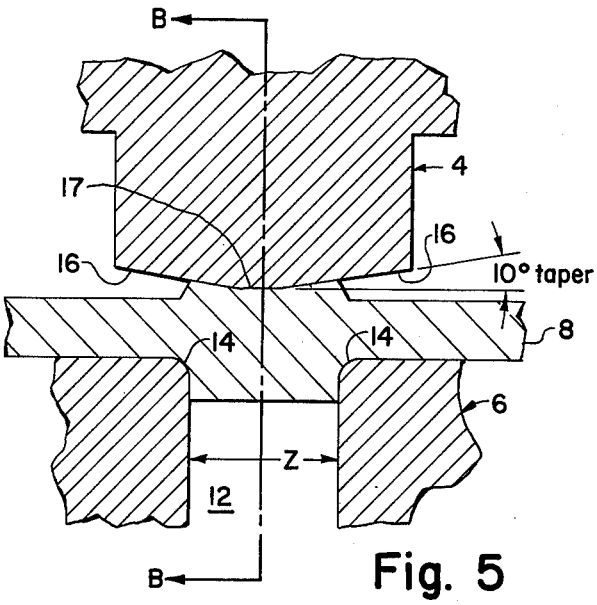
FIG. 5 is a cross sectional view similar to FIG. 2 except the punch has been lineally displaced in the direction of the die.

FIG. 5 shows punch 4 after it has been displaced lineally against the rib 10 on the web 8 to extrude or flow material from the floor member into the aperture 12 in the die 6. Since the punch 4 has a width greater than the rib and therefore greater than the extent Z of the aperture 12, no cracking takes place between the base of the rib and the web of the floor member because the transition zone 14 provides support to extrude and guide the metal into the aperture 12 of the die 6. To facilitate extruding metal into the die, the end face of the punch, which comes in contact with the wear surface of the rib, may have a projecting ridge 17 and be tapered upwards from the horizontal on both sides thereof transverse to the rib. This forms two tapered surfaces 16 on the end face of the punch along the direction of the rib. An angle in a range of 5° and 15°, and preferably approximately 10°, between the tapered surfaces and a plane perpendicular to punch travel has been found to work satisfactorily, but the angle of taper may be as much as 30°.

Figure 6:
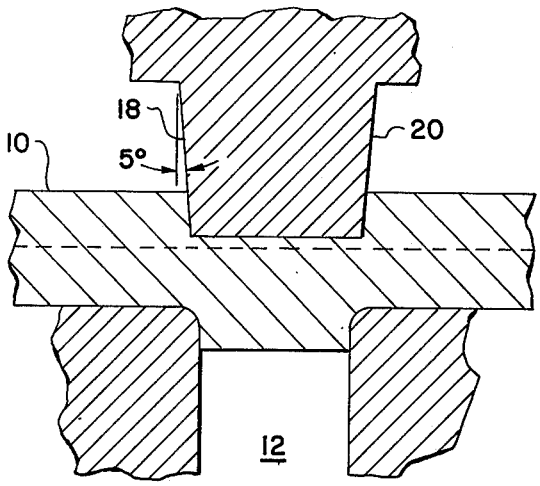
FIG. 6 is a cross sectional view taken along the line B—B of FIG. 5.

From FIG. 6 it is apparent that sides 18 and 20 of punch 4 after being displaced lineally in the direction of the die 6 are in contact with rib 10. To prevent locking of the sides of the punch with the rib with which it is in contact, sides 18 and 20 may be tapered about 5° from the perpendicular thus allowing easy withdrawal of the punch from the depression in the rib.

Figure 7:
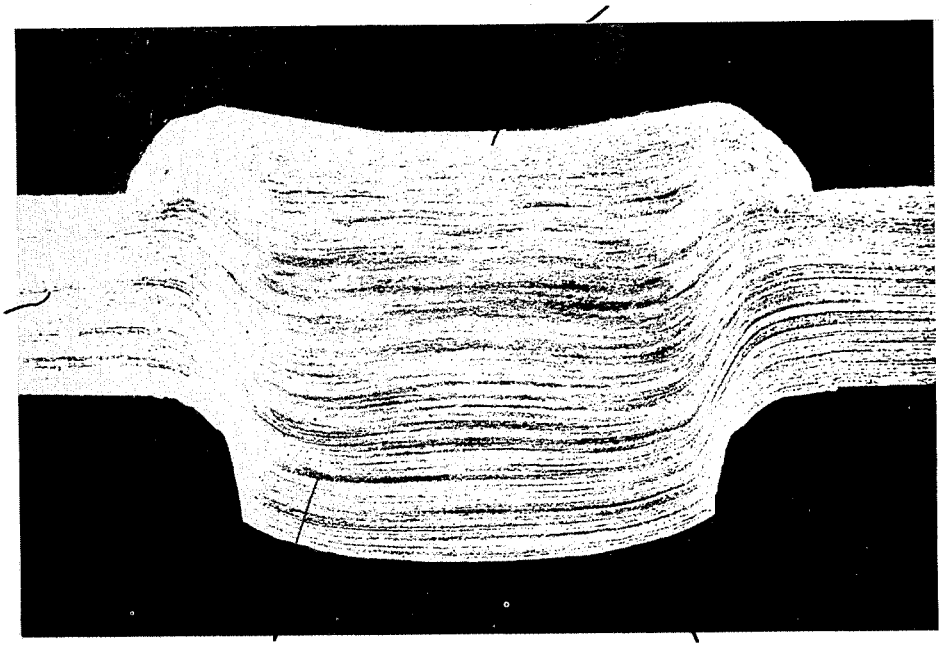
FIG. 7 is a photomicrograph of a cross section of a rib of a floor member similar to that shown in FIG. 5 illustrating the flow lines of the metal and the integrity of the floor member with practice of this invention.

FIG. 7 is a photomicrograph showing metal flow lines in a cross section of an exemplary depression which has been made in a rib in accordance with this invention. As is well known, when metal is worked by extrusion, for example, the grains of the metal are established along lines of flow which are oriented in the direction of working. These lines may be referred to as metallurgical flow lines. It will be noted that the metallurgical flow lines in FIG. 7 are substantially continuous from the depressed rib segment 22 into the metal web 8 adjacent the rib and, therefore, the floor member is crack-free. It is to be further noted that portion 24 of the depressed rib section extruded into the die is smaller than the residual portion 26 forming the floor of the depression in the rib 10.

Figure 8:
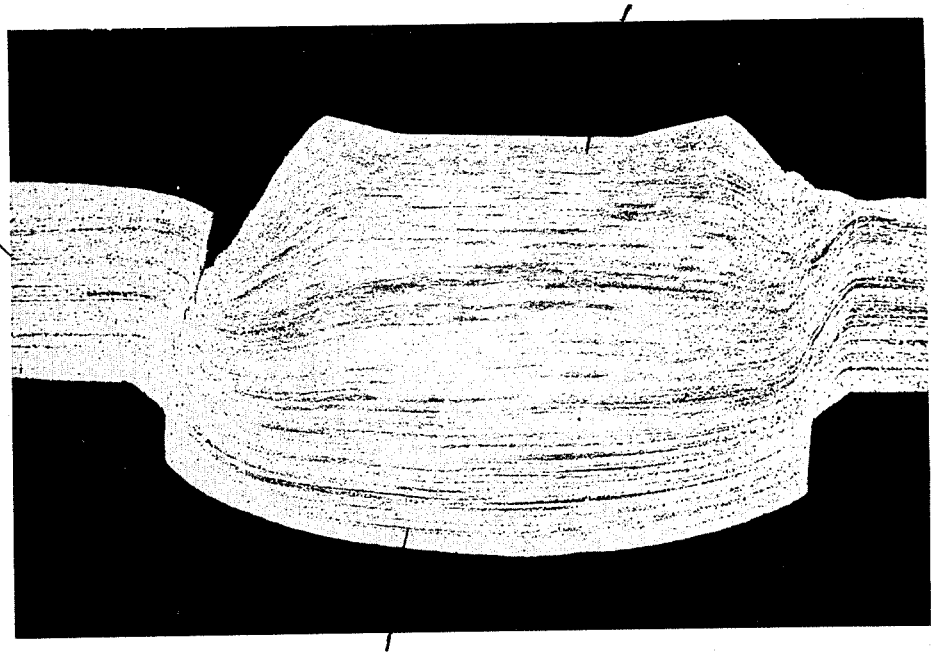
FIG. 8 is a photomicrograph similar to FIG. 7 illustrating the undesirable cracked condition resulting from use of a conventional punch and die assembly.

FIG. 8 is a photomicrograph of a cross section through a depression made in a rib of a floor member by a conventional punch and die assembly. It will be observed that most of the metallurgical flow lines terminate on one side at a crack 28 which extends almost all the way through the member. This type of crack typically accompanies depressions made by a conventional punch and die. In further examination of FIG. 8, it will be noted that the extruded portion 30 is larger than the residual portion 32 forming the floor of the depression in the rib 10. This is indicative of the conventional punch and die where the aperture in the die is larger than the punch as exemplified by the portion 30 of the metal extruded into the aperture.

The advantage of this novel method for forming depressions in ribbed floor members is that depressions may be made in the rib much deeper than with the conventional punch and die. When a conventional punch and die is used, cracking may occur at a depression depth of only 0.040 inch in a rib 0.090 inch high on a web 0.080 inch thick which generally provides ineffective skid resistance. With using this new method, depressions greater than the depth of the rib have been obtained without cracking and, therefore, without adversely affecting the integrity of the ribbed floor member. As an example of the effectiveness of this novel method, where the rib height was 0.090 inch on a member having a web thickness of 0.080 inch, depressions have been made as deep as 0.100 inch without cracking.

Figure 9:
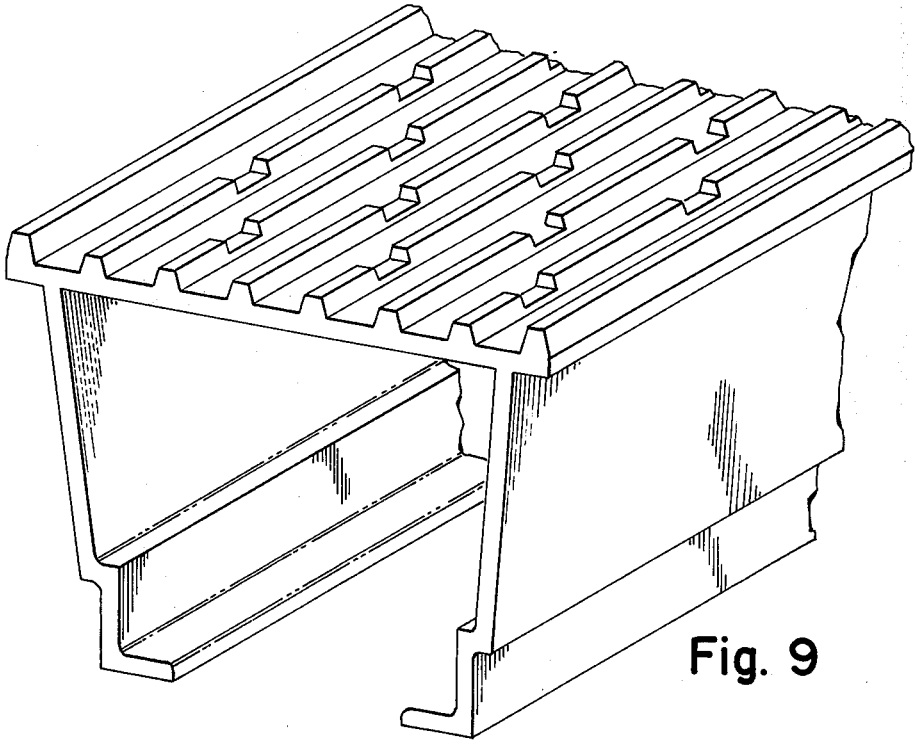
FIG. 9 is a perspective view similar to FIG. 1 illustrating an alternative form of skid resistant floor member of this invention.

FIG. 9 illustrates another feature that may be obtained by the practice of this invention. Certain ribs on a ribbed floor member may be free of depressions, yet other adjacent ribs may be provided with depressions. Such an arrangement may be useful in truck floors, for example, where boxes and the like may be moved easily on the depression-free ribs yet the ribs adjacent with depressions therein provide excellent skid resistance.

In view of the above disclosure, appended drawings and claims, variations and modifications will doubtlessly become apparent to others skilled in the art. All embodiments thereof are encompassed insofar as they fall within the reasonable spirit and scope of this invention and the appended claims.

We claim:

1. A method of forming crack-free depressions in the wear surfaces of ribs on a floor member to improve skid resistance thereof, said method comprising the steps of:

a. supporting a floor member having at least one rib thereon against a die having an aperture therein with the rib on the floor member disposed on the side of the floor member opposite the die and overlying the die aperture which has an effective extent less than the width of the base of the rib; and b. displacing a segment of the rib toward the die aperture with a punch having a length along the rib greater than the effective extent of the aperture in the same direction and a width across the full upper surface of the rib opposite the aperture in the die, and thereby move material from the floor member into the aperture to form a depression in said rib without cracking the floor member.

2. A method according to claim 1 wherein the die aperture has a maximum cross-sectional extent at the mouth thereof underlying said floor member and transverse to the rib, said maximum extent is greater than the width of the base of the rib, said die aperture converging from said maximum extent through a transition zone to a minimum extent less than the width of the base of the rib.

3. A method according to claim 2 wherein the aperture has an extent as its mouth parallel to the rib greater than the length of said segment along the rib.

4. An apparatus for forming crack-free depressions in the wear surfaces of ribs on a floor member to improve skid resistance thereof, said apparatus comprising:

a. a die for supporting a floor member having at least one rib thereon, said die having an aperture therein opposite the rib on the floor member with said aperture having an effective extent less than the width of the base of the rib; and b. a punch having an end face thereon which is adapted for contacting the rib and which has a dimension parallel to the rib greater than the effective extent of the aperture in the same direction, said end facing having a width at least equal to the full width of the upper surface of the rib, said punch being adapted to displace a segment of the rib toward the die to move material from the floor member into the die aperture to form a depression in the rib without cracking the floor member.

5. An apparatus according to claim 4 wherein the aperture has a maximum extent at the mouth thereof underlying said floor member and transverse to the rib, said maximum extent is greater than the width of the base of the rib, said aperture converging from said maximum extent through a transition zone to a minimum extent less than the width of the base of the rib.

6. An apparatus according to claim 5 wherein the aperture has a maximum extent in the direction of the rib greater than the dimension of the end face of the punch along the rib.

7. An apparatus according to claim 4 wherein the aperture in the die is generally circular and the punch is generally rectangular in cross section.

8. An apparatus according to claim 5 wherein the aperture has a curved transition zone between the maximum extent and the minimum extent.

9. An apparatus according to claim 4 wherein the end face of said punch has a projecting ridge thereon and surfaces on opposite sides thereof tapered rearwardly from said projection and forming an angle with a plane perpendicular to the direction of punch travel in a range of 5° to 15°.

10. An apparatus for forming a crack-free, skid-resistant floor having depressions in ribs on the wear surface of floor members, comprising:

a. a die for supporting a floor member having at least one rib thereon, said die having a generally circular aperture therein opposite the rib on the floor member with said aperture having a maximum diameter at the mouth thereof and converging inwardly through a curved transition zone to a minimum diameter; and b. a punch having a generally rectangular cross sectional configuration with an end face adapted to press against the upper surface of the rib, said end face having:

i. a dimension along the rib substantially equal to the maximum diameter of the circular aperture, ii. a width across the full width of the upper surfce of the rib; and iii. a projecting ridge thereon and surfaces on opposite sides thereof tapered rearwardly from said projection and forming an angle with a plane perpendicular to the direction of punch travel in a range of 5° to 15°.

* * * * *